United States Patent [19]

Rogers

[11] Patent Number: 4,494,897

[45] Date of Patent: Jan. 22, 1985

[54] DAMAGE PREVENTION VOID FILLER FOR SEPARATING LOADS DURING TRANSIT

[76] Inventor: Eugene A. Rogers, Arlington Heights, Ill. 60004

[21] Appl. No.: 465,522

[22] Filed: Feb. 10, 1983

[51] Int. Cl.[3] ..... B61D 45/00; B63B 25/24; B65D 81/04

[52] U.S. Cl. ..... 410/154; 108/51.3; 206/593

[58] Field of Search ..... 52/381, 577, 731; 108/53.1; 206/593; 410/154, 155; 428/12

[56] References Cited

U.S. PATENT DOCUMENTS

| | | | |
|---|---|---|---|
| 3,421,451 | 1/1969 | Brucks | 410/154 |
| 3,464,367 | 9/1969 | Latter | 410/155 |
| 3,534,691 | 10/1970 | Carlomagno, Jr. | 410/155 |
| 3,593,671 | 7/1971 | Bramlett | 410/154 |
| 3,854,426 | 12/1974 | Kinnune, Jr. | 410/154 |
| 4,109,587 | 8/1978 | Jansen, Jr. | 410/154 |
| 4,363,579 | 12/1982 | Rogers | 410/154 |
| 4,372,717 | 2/1983 | Sewell et al. | 410/154 |
| 4,386,881 | 6/1983 | Liebel | 410/154 |

*Primary Examiner*—Robert B. Reeves
*Assistant Examiner*—David F. Hubbuch
*Attorney, Agent, or Firm*—James J. Conlon; Paul A. Kerstein

[57] ABSTRACT

A collapsible, corrugated damage prevention device for separating freight in transit in railroad cars, trucks, and the like is provided and includes an outer tube like member and a collapsible spreader core inside the outer tube and at right angles to the sides of the outer tube. One version provides an outer tube like member and a second tube like member inside and at right angles to the outer tube. Another version provides a U-shaped outer section with outwardly extending flanges covered with a cap sheet to provide a hollow interior. The sides of the void filler are scored to allow each side to be easily folded outwardly from the core member thus disposing the entire device in a flat configuration which can be easily stored when not in use.

7 Claims, 11 Drawing Figures

DAMAGE PREVENTION VOID FILLER FOR SEPARATING LOADS DURING TRANSIT

BACKGROUND OF THE INVENTION (1) Field of the Invention:

This disclosure pertains to a shock absorbing, damage prevention device for use in separating and restraining loads during transit. More specifically, this disclosure shows a highly portable, one piece, corrugated void filler which is shipped in a so-called knock down or flat configuration and is assembled in the field to a highly rigid void filler.

(2) Description of the Prior Art:

Prior art void fillers such as those disclosed by the Kinnune U.S. Pat. No. 3,854,426 (1974) disclose honeycomb products which are suspended from and adapted to extend the full height of the transported product. These void fillers have met with some limited success but are chronically plagued with problems involved in initially positioning the void filler to insure it deploys the full height of the load and thereafter keeping the void filler in place during transit. Also, costs are prohibitive because of manufacturing techniques which require not only automatic machinery for applying adhesive but also extensive cutting and forming machines to produce the component parts. Further, it has been observed that at the end of the useful life of the prior art void fillers, there are problems involved with cleanup and disposal of these large, bulky products which cannot be reused or easily dismantled.

Another type of so-called void filler is the dunnage plug shown in the Brucks U.S. Pat. No. 3,421,451 (1969). This structure provides a number of U-shaped, interlocking, corrugated sections. Because the numerous component parts are scored and slotted, they are thus compatible only with the correspondingly slotted and scored members and are prone to being easily damaged and/or lost.

Another type of void filler or plug is shown in the Carlomagno U.S. Pat. No. 3,534,691 (1970) and the Latter U.S. Pat. No. 3,464,367 (1969). The constructions shown in these patents involve box-type units. The '691 patent shows flaps integrally cut therein and extending outwardly for the purpose of fitting between load members to support the box in position. The Latter structure shows open top type box members with flanges extending outwardly therefrom. The top members or caps receive an accordion-shaped member which extends between the adjacent loads. The structures shown in the two patents have not met with widespread acceptance because custom-made dies must be made to cut the required contours in order that the box sections may be folded together. Furthermore, these box-shaped sections do not provide interchangeable parts which can be used when different sized spacings are encountered between loads.

One other device shown recently in U.S. Pat. No. 4,109,587 (1978) is the invention of Jansen entitled Load Spacer Support. The device shown in this patent is a honeycomb type of device having a center portion 42 which maintains the honeycomb divider and expanded configuration during use. The Jansen device has not met with widespread acceptance because it is thought that the costs are high, and, because of the several pieces involved, the portion which holds the honeycomb members expanded can be misplaced or lost thus rendering the entire unit workable.

SUMMARY

Today, cases of canned goods, food products, household items, and other products too numerous to name are transported by truck and railroad freight cars. These commodities are generally shipped in cardboard boxes which are stacked on pallets or arranged as so-called unitized loads which are groups of boxes held together with a wrap such as banding or so-called stretch wrap or shrink wrap which is a layer of sheet plastic which encircles or otherwise encloses the group of boxes. The void filler of this disclosure is adapted for use in separating virtually any arrangement of boxes during shipment. More specifically, it is particularly designed for use with shrink wrapped, stretch wrapped, spot glued, and unitized loads.

Commonly used load separating devices are normally adapted to be suspended from the roof of the transporting vehicle or attached to certain types of attaching rails along the sides of the vehicle. Frequently, however, the transporting vehicle has no provision for the attachment of any damage prevention device Thus, the product disclosed herein is uniquely suited for all vehicles regardless of whether the vehicle has any attachment means for a load separating and damage prevention device on the roof or sides. Also, a feature of this invention is that it is uniquely suited to prevent damage to loads without regard to the type of vehicle in which the load is being transported. Thus the commonly used damage prevention devices which are custom fitted to the supporting structure on the inside of the vehicle are only adapted to fit a certain type of vehicle and cannot be used interchangeably, for example between semitrailers and railroad vehicles utilizing another manufacture's type of damage prevention device.

This disclosure pertains to a so-called void filler which may be mounted in vacant spaces between adjacent loads during transit. The product disclosed is constructed from corrugated cardboard and includes a central collapsible core attached in an outer tube that provides a tube in tube construction. One form of the invention includes flanges extending from the top of the structure to aid in holding the void filler in position between stacked loads.

The collapsible diamond shaped core is attached to the top and bottom within the outer hollow section which has scored sides, a bottom and flanges to which a cap sheet is attached.

The core is essentially a spreader member which holds the sides apart and prevents their inward movement. The preferred form of the core is diamond shape with a foot attached with an adhesive to the top and bottom of the hollow section. Diagonal legs extend outwardly from the attached parts and join at each end of the hollow portion in the form of a parallelogram when the void filler is expanded.

In use, the void filler may be assembled on-site, positioned at the top portion of a unitized load and adapted to separate the load from an adjacent, unitized load or from the side or end walls of the transporting vehicle. When used to separate vertically adjacent loads, the void filler is suspended by the top flanges. The version which does not have flanges may be stacked atop each other.

It is an object of this disclosure to provide a highly portable, one piece, void filler that is easily transported in a knocked down, flat configuration and does not occupy a large volume and yet can be easily expanded in the field to fill a large volume and maintain a rigid configuration during transit to maintain a load in position and absorb otherwise damaging shocks and forces.

Another object of this disclosure is to provide a void filler which is used as a one-piece unit and is made as a tube within a tube, each tube located at right angles to the other tube.

It is yet another object of this disclosure to provide a void filler having outwardly extending flanges interconnected by a cap sheet which adapts the void filler to be positioned between vertical loads and/or which can be bent upwardly to allow the void filler to be wedged between side by side loads or a wall or be nailed to a side wall of the transporting vehicle.

It is also an object to provide the flanges in such a form (by scoring the adjacent cap sheet) that when folded into a vertical plane each will provide a spring effect which assists in holding the void filler in position.

It is yet another object of this disclosure to provide a one piece void filler having a collapsing core and folding sides which can be expanded into a rigid shock absorbing member and which bows outwardly to provide a spring force to hold the void filler in place.

Another object of this disclosure is to provide a one piece, corrugated fiber board, void filler which can be easily assembled, stored and shipped in a completely flat configuration, and, quickly expanded for use in separating freight with no specialized training of the user.

These and other objects of the disclosure will become apparent to those having ordinary skill in the art with reference to the following description, drawings and appended claims.

DETAILED DESCRIPTION

Figure 1:
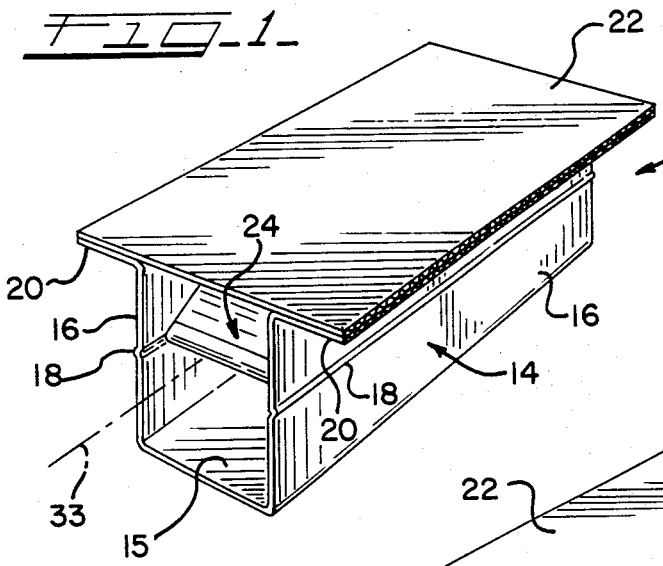
FIG. 1 is a pictorial illustration of the void filler.

Referring now to the drawings and in particular to FIG. 1, there is shown a pictorial illustration of one version of the assembled and expanded void filler as it would appear in position separating freight during transit. Essentially, this void filler 10 is constructed from three pieces held together by an adhesive. A U-shaped housing 14 provides three sides of the outer enclosure and includes upwardly extending sides 16 which are divided into an upper and lower portion divided by a scoring bead 18. The scoring bead is applied by any well known method such as an automatic roller or a manual device and is intended not to pierce, cut or otherwise weaken the material but to allow the sides 16 to be easily folded outwardly when it is necessary to collapse the void filler for storage or shipment by a user. The top of each side 16 includes laterally and outwardly extending flanges 20. Thus as shown in FIG. 1, the housing 14 provides a three sided enclosure having outwardly extending flanges 20.

A cap sheet 22 is attached to each flange 20 by an adhesive although it is contemplated that a staple, rivet, brad or other mechanical connector could be also used to join cap sheet 22 to each corresponding flange 20 of the housing 14 to provide an elongated, outer tube.

Figure 3:
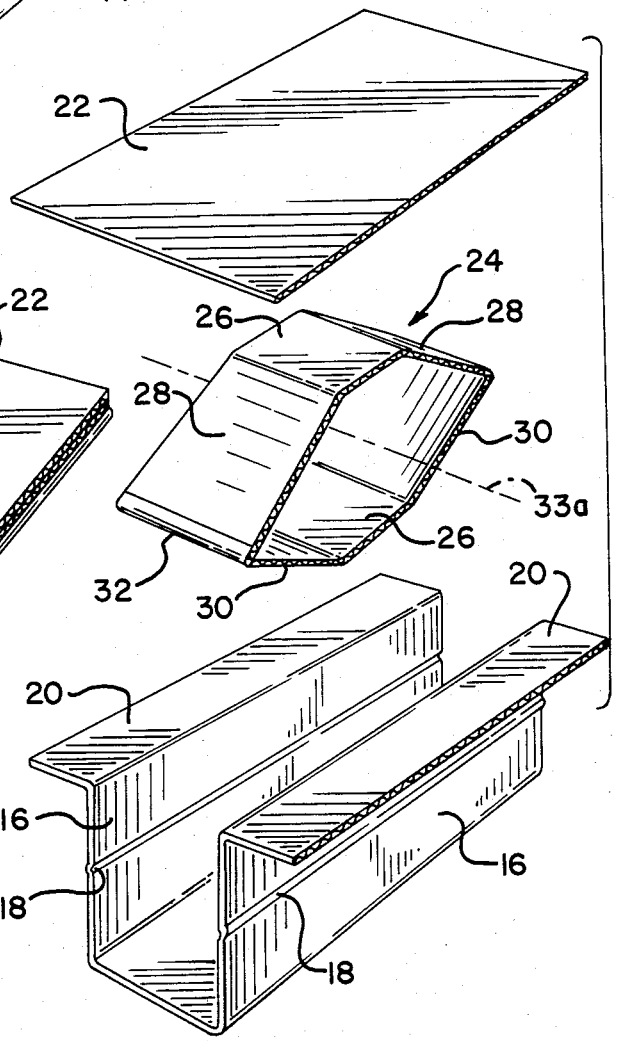
FIG. 3 is an exploded view of the void filler.
Figure 5:
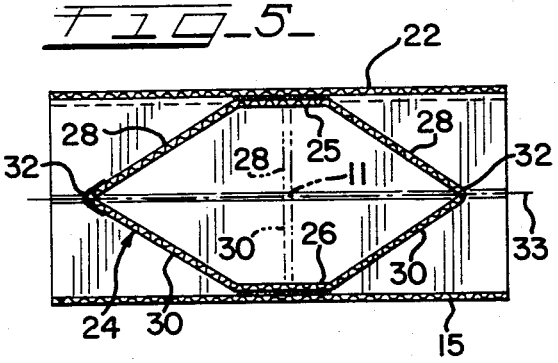
FIG. 5 is a sectional view taken generally along lines 5—5 of FIG. 4.

As shown in FIGS. 3 and 5, a central core member 24 is located in the interior or hollow portion provided by the housing 14 and associated cap sheet 22. Core 24 is essentially diamond shaped and has upper and lower attaching feet 25, 26, respectively which are attached by an adhesive, staple, brad or other mechanical connector to the bottom 15 of the housing 14 and the underside of cap sheet 22.

Outwardly extending diagonals 28 extend from the upper foot 25 and upwardly extending diagonals 30 extend from the lower foot 26. Each of these diagonals converge and form a nose or apex 32 which is formed at a scored portion to allow the core to bend easily at each nose 32 as the unit is collapsed for storage. The diagonals act as spacers to keep sides 16 from collapsing.

The three piece void filler when assembled provides a one piece, unitized construction which folds into a virtually flat configuration when not in use and is expanded to form an internally reinforced beam-type structure which absorbs shock during transport of loads and prevents damage to the load. This design provides an outer tube consisting of bottom 15, sides 16 and cap sheet 22 having a longitudinal axis 33 (FIG. 1) and an inner tube or core 24 with axis **33*a* (FIG. 3). When assembled, the axes 33, 33*a*** are perpendicular to each other and provide resistance to crushing and distortion (shear forces).

While the hollow tube-in-tube construction is fine, it is contemplated that certain modifications could be made. For example, on shorter void fillers a completely enclosed tube is not mandatory. For example, one half of the core 24, as shown in FIG. 5, could be used. Also, the diagonals 28, 30 need not be at the angles disclosed but could be more vertical to act as rigidifying spacers and beams to contact and hold in place the spaced sides 16. Either single-spacers (FIG. 5 dotted lines) or double spacers (FIG. 9) could be used. Of course, the spacer(s) would have to be scored at 41 or pre folded to insure that each would collapse when the tops **22, 22*a* are urged downwardly towards the bottom 15. If additional spacers were needed, they could easily be provided along the length of the outer tube or housing 14**.

Figure 6:
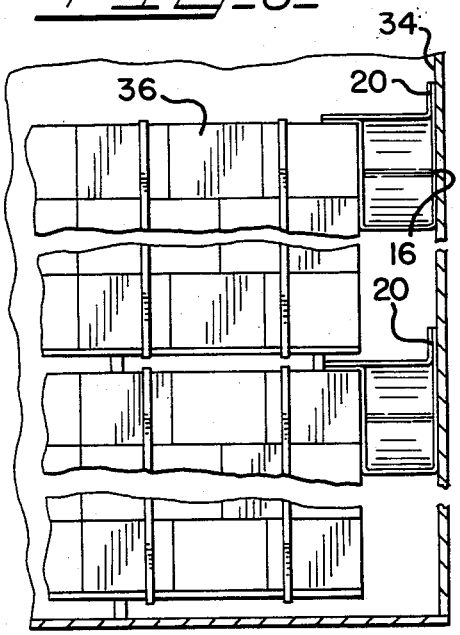
FIG. 6 is a view showing one application of the void filler.
Figure 7:
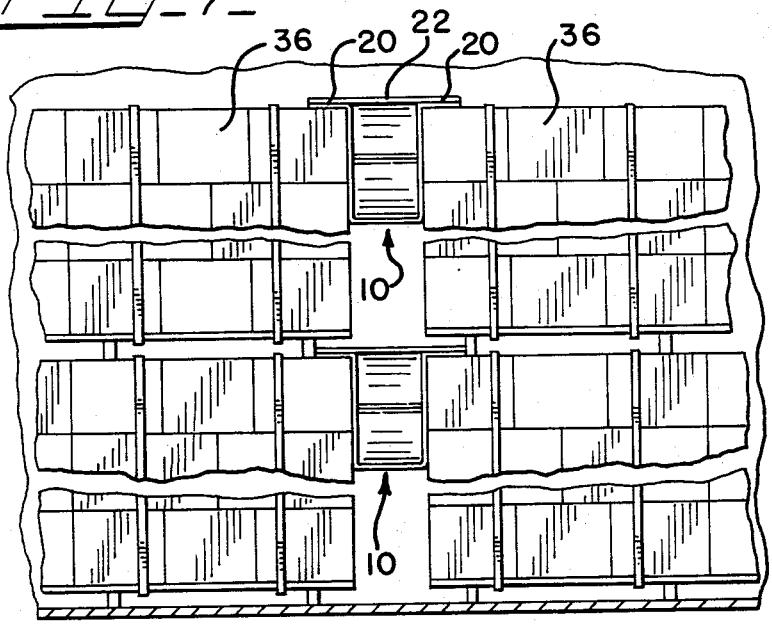
FIG. 7 shows another way to use the void filler.

Flange members 20 in combination with the adjacent portion of the cap sheet 22 not only provide stiffness to the upper portion of the void filler 10 but provide convenient attachment extensions for positioning the void filler as shown in FIGS. 6 and 7.

One use of the expanded, flange type void filler 10 is shown in FIG. 7. Here the void filler is merely suspended by flanges 20 between adjacent loads 36 to prevent movement of the load and absorb otherwise damaging shock. As shown the void filler is easily positioned in place and easily removed when it is necessary to remove the loads 36.

Figure 2:
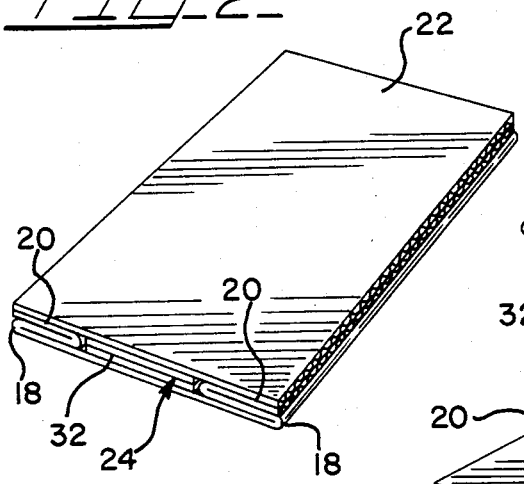
FIG. 2 is a pictorial illustration of the void filler in a flat, knocked down, configuration.
Figure 4:
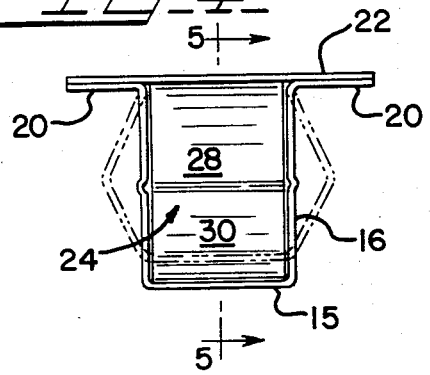
FIG. 4 is an end view of the void filler in position.
Figure 10:
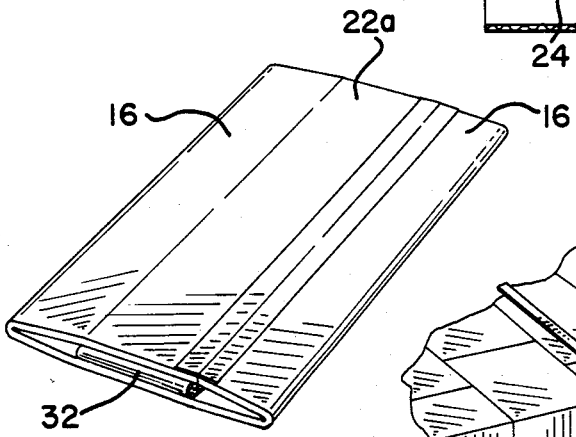
FIG. 10 shows the void filler of FIG. 8 in the collapsed position.

When the void fillers are expanded from the flat positions in FIGS. 2 and 10, the sides 16 are not perfectly straight but slightly bowed as shown in Phantom in FIG. 4. When the void filler is inserted into a snug space between loads as shown in FIG. 7 the sides are bowed outwardly and into the load 36 and as the sides 16 are flattened and provide a spring force effect urging sides 16 into the load thus helping the void fillers in place.

Another use of the void filler is illustrated in FIG. 6. Here, void filler 10 is used between the side of a vehicle 34 and the load 36. In such position the area of cap sheet 22 adjacent the flange 20 is scored and the flange 20 is bent upwardly to be positioned in the same plane as the sides 16 of the void filler and thus provide an additional spring effect urging the flange 20 against the wall 34 for the purpose of holding the void filler securely in place. On the other hand, in the position illustrated in FIG. 6 the flange 20 may be nailed to the side wall of the vehicle and positively held in place where the structure of the vehicle will accept nailing.

Structurally it is contemplated that a 200 pound double wall corrugated cardboard or fiberboard would be used for the U-shaped housing 14 and the cap sheet 22. A 200 pound C-flute, corrugated cardboard or fiberboard is recommended for use as the core 24. Because the loading applied to the core is compression loading; as opposed to the shear and abrasion loads that are applied to the housing 14 and cap sheet 22, it is anticipated that the core 24 may, at times, be of heavier construction. Also, while dimensions vary as required by each shipper and the nature of each load, the type of void filler as shown in FIG. 1 has the following dimensions. In the expanded position, the distance between the sides 16 is six inches and the height between the top of cap sheet 22 and the bottom 15 is 16 inches. The cap sheet 22 is 21 and ½ inches wide and 40 inches long. Thus, in the collapsed position the volume occupied by the void filler 10 is 22 inches by 40 inches by approximately ¾ of an inch thick.

Figure 8:
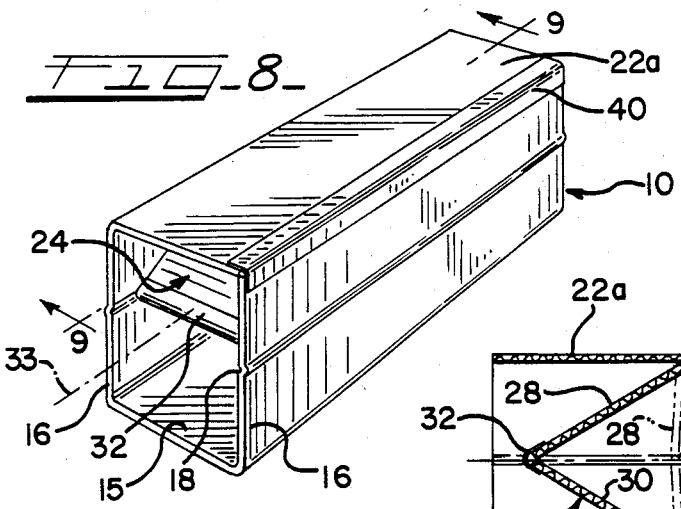
FIG. 8 shows a modified form of the void filler.

A modified form of the invention is shown which does not utilize the flanges 20 shown in the earlier illustrations 1–7. The pure tubular arrangement is shown in FIGS. 8–11. Similar numbers refer to similar portions of this tubular configuration which, as mentioned earlier, is merely a configuration that does not utilize flanges 20 shown in the prior version. The void filler 10 includes an outer tube having a bottom 15 and upstanding sides 16. Extending along the center portion of each side 16 is a scoring bead 18 which allows the sides to be folded outwardly into the flat position shown in FIG. 10. Instead of the cap sheet 22 used in the earlier described version, the tubular construction shown in FIG. 8 utilizes a top designated **22*a* which is positioned parallel with the bottom 15 and may be attached to the upstanding, corresponding side 16 by tape 40, an adhesive or the like. It is understood that the outer tube of FIG. 8 may have overlapping sides joined by tape, adhesive, staples or other mechanical fastener to complete the outer tube. Thus, constructed as shown in FIG. 8, the outer tube has a longitudinally extending axis designated 33 and also shown in FIG. 9**.

The core is also designated by the numeral 24 as essentially identical with the core shown in the earlier illustration. Consequently, the numerical identity of the various portions is the same. As with the earlier version the foot 25 may be attached to the top **22*a*** of the outer tube by a suitable adhesive, staple or other mechanical fastening means.

Figure 11:
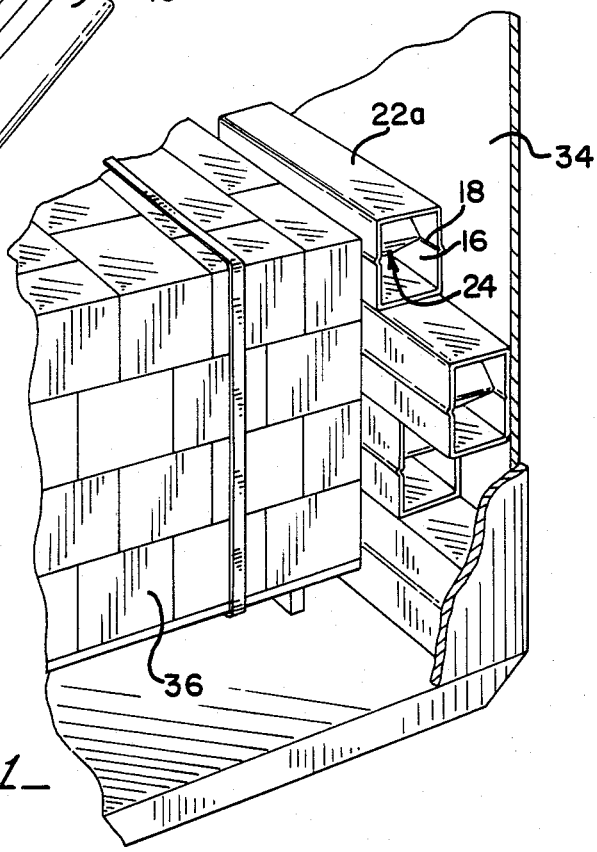
FIG. 11 is a pictorial illustration showing the void filler in position between a load and a vehicle side wall.

Thus, constructed, the void filler disclosed in FIG. 8 provides a one piece assembly made from but two component members comprising an outer tube with an inner tube located inside which has an axis at right angles to the axis of the outer tube. In such position the expanded void filler provides resistance to crushing of the core 24 and also provides a rigid member which resists abrasion and shear forces because of the outer tube 10. As with the earlier described version, the sides 16 are provided with a spring effect to hold them in position as illustrated in FIG. 11. The sides bow outwardly as do the sides shown in FIG. 4 and thus when placed in a tight fitting compartment between adjacent loads or between loads and a side wall the sides 16 are urged into a vertical position adjacent the core 24 and a spring force is created which holds the void filler in position.

As shown in FIG. 11, the void filler may be positioned between the load 36 and an outer wall 34. The individual void fillers shown are stacked one atop another, however, it is contemplated that the void fillers could be spaced and held in place by the spring force provided by the sides 16.

As with the earlier described version, this version may be easily assembled in the field by personnel having no specialized training. The operation of the void filler is self-explanatory and requires no assembly. Also, because of the compact configuration as shown in FIG. 10, the knocked down void filler may be easily stored when not in use or easily transported to a shipper.

Figure 9:
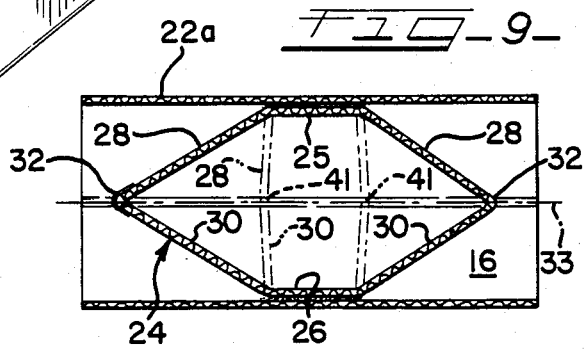
FIG. 9 is a sectional view taken along line 9—9 of FIG. 8.

Certain modifications could be made with the above structure by varying the type of material used or the type of connectors used in assembling the unit or by various core designs as shown in FIGS. 5,9, and described above.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

I claim:

1. A collapsible void filler damage prevention device adapted to fold into a flat configuration and be unfolded into an expanded configuration for protecting cargo during transit, the improvement comprising:

an outer housing providing a four sided, tubular member having a bottom, top and two sides and a longitudinal axis extending the length thereof;

said sides adapted to extend upwardly from the bottom to said top when the damage prevention device is in said expanded configuration, and, said sides having means for bowing the sides outwardly to thereby allow the void filler to collapse easily and provide an outwardly directed spring force on adjacent objects to hold the void filler in place when the sides are in said expanded configuration;

core means with means attached within said tubular member to hold the core means in position and having leg means extending to connect the bottom and top of the outer tubular member, said core means having a width to thereby contact and space apart the sides to prevent their inward movement and rigidify the outer tubular member when the void filler is in the expanded configuration;

said core means having means to allow it to be folded and collapsed when the outer housing is collapsed.

2. The void filler of claim 1 wherein said leg means extending to connect the bottom and top of the outer tubular member includes:

diagonal members extending in zig-zag, angled fashion between the top and bottom of the outer member and having two leg members extending from said top in a downwardly and outwardly direction to an apex where they join with other leg members extending in a downwardly and inwardly direction.

3. The void filler of claim 1 wherein:

said means to allow the core means to be folded includes integrally formed score indentations.

4. The void filler of claim 1 wherein said core means includes:

a plurality of sides being connected and forming an enclosed, second tube having a second longitudinal axis positioned perpendicular to the longitudinal axis of the outer, four sided tubular member when the void filler is in the expanded position.

5. The void filler of claim 1 wherein said core means includes:

a diamond shaped enclosure having foot members attached to said bottom and top of said outer tubular member to securely hold the core means in position:

said leg means comprising diagonal members extending from each foot and joined at an apex and connecting the bottom and top.

6. The void filler of claim 1 wherein said outer housing includes:

outwardly extending flange means;

a cap sheet forming said top and having a section extending adjacent and attached to said flange means;

said flange means extending outwardly of the four sided tubular member and adapted to hold said void filler in position between adjacent loads.

7. The void filler of claim 6 wherein said cap sheet includes:

a scored portion along the length adjacent to said flange means to allow the cap sheet and attached flange means to be moved, upwardly and downwardly to a nonhorizontal position thereby providing a spring force urging the flange means outwardly to hold said void filler in position.

* * * * *

US004494897B1

REEXAMINATION CERTIFICATE (1952nd)

United States Patent [19]

Rogers

[11] B1 4,494,897

[45] Certificate Issued Mar. 23, 1993

[54] DAMAGE PREVENTION VOID FILLER FOR SEPARATING LOADS DURING TRANSIT

[75] Inventor: Eugene A. Rogers, Arlington Heights, Ill.

[73] Assignee: Illinois Tool Works Inc., Glenview, Ill.

Reexamination Request:
No. 90/002,644, Feb. 14, 1992

Reexamination Certificate for:

| | |
|---|---|
| Patent No.: | **4,494,897** |
| Issued: | **Jan. 22, 1985** |
| Appl. No.: | **465,522** |
| Filed: | **Feb. 10, 1983** |

[51] Int. Cl.[5] ..... B61D 45/00; B63B 25/24; B65D 81/04

[52] U.S. Cl. ..... 410/154; 108/51.3; 206/593

[58] Field of Search ..... 52/381, 577, 731; 206/593; 410/154, 155, 121; 428/12; 108/53.1, 51.3

[56] References Cited

U.S. PATENT DOCUMENTS

| | | | |
|---|---|---|---|
| 2,957,668 | 10/1960 | Norquist et al. | 108/51.3 |
| 3,079,876 | 3/1963 | Doane . | |
| 3,079,877 | 3/1963 | Doane . | |
| 3,405,659 | 10/1968 | Hees . | |
| 4,386,881 | 6/1983 | Liebel . | |
| 4,865,889 | 9/1989 | Boyse . | |

*Primary Examiner*—Michael S. Huppert

[57] ABSTRACT

A collapsible, corrugated damage prevention device for separating freight in transit in railroad cars, trucks, and the like is provided and includes an outer tube like member and a collapsible spreader core inside the outer tube and at right angles to the sides of the outer tube. One version provides an outer tube like member and a second tube like member inside and at right angles to the outer tube. Another version provides a U-shaped outer section with outwardly extending flanges covered with a cap sheet to provide a hollow interior. The sides of the void filler are scored to allow each side to be easily folded outwardly from the core member thus disposing the entire device in a flat configuration which can be easily stored when not in use.

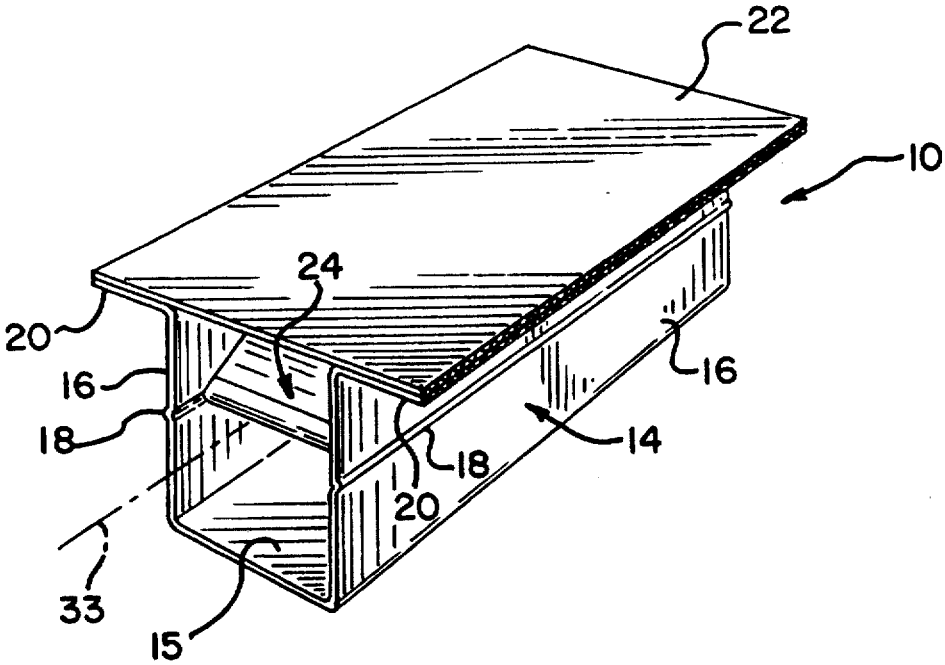

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claims 1-3, 5 and 7 are determined to be patentable as amended.

Claim 6, dependent on an amended claim, is determined to be patentable.

New Claims 8-13 are added and determined to be patentable.

1. A collapsible void filler [damage prevention] device [adapted to fold] *foldable* into a flat, *collapsed* configuration *for storage* and [be unfolded] *unfoldable* into an expanded configuration for [protecting] *preventing damage to* cargo during transit, [the improvement] comprising:

an outer housing [providing] *comprising* a four sided, tubular member having a bottom, *a* top, and two sides, and a longitudinal axis extending the length thereof;

said sides *of said outer housing tubular member* [adapted to extend] *extending* upwardly from [the] *said* bottom *of said outer housing tubular member* to said top *of said outer housing tubular member* when [the] *said* damage prevention device is *disposed* in said expanded configuration, and, said sides [having] *of said outer housing tubular member comprising* means for *permitting said* [bowing the] sides *of said outer housing tubular member to bow* outwardly *so as* to thereby allow [the] *said outer housing tubular member* [void filler] to collapse easily and *to* provide an outwardly directed spring force [on] *upon* adjacent objects *so as* to hold [the] *said* void filler in place when [the] *said sides of said outer housing tubular member* are *disposed* in said expanded configuration; *and*

*an inner member comprising a single cell tubular* core [means with means attached] *disposed* within said *outer housing* tubular member [to hold the core means in position] and having [leg means extending to connect] *a bottom connected to said* [the] bottom *of said outer housing tubular member, a* [and] *top connected to said* top of [the] *said* outer *housing* tubular member, *and sides interconnecting said bottom and said top of said inner member tubular core,* said *inner member tubular* core [means] having a *longitudinal axis extending the length thereof which is disposed perpendicular to said longitudinal axis of said outer housing tubular member, a width which extends across a majority of said length of said outer housing tubular member, and wherein said length of said inner member tubular core is sized so as* [a width] to [thereby] contact and space apart [the] *said* sides *of said outer housing tubular member so as* to prevent [their] inward movement *of said sides of said outer housing tubular member* and *thereby* rigidify [the] *said* outer *housing* tubular member when [the] *said* void filler is *disposed* in *said* [the] expanded configuration;

said *sides of said inner member tubular* core [means] having means [to allow] *for allowing* [it] *said sides of said inner member tubular core* to be folded and collapsed when *said* [the] outer housing *tubular member* is collapsed.

2. The void filler of claim 1, wherein said [leg means extending to connect ] *sides of said inner member tubular core interconnecting said* [the] bottom and *said* top of [the outer tubular] *said inner* member *tubular core comprise* [includes]:

diagonal members extending in *a* zig-zag, angled fashion between [the] *said* top and bottom of [the outer] *said inner* member *tubular core* and [having] *comprising* two leg members extending from said top *of said inner member tubular core* in a downwardly and outwardly direction to an apex where [they] *said two leg members* join [with] *two* other leg members extending in a downwardly and inwardly direction *toward said bottom of said inner member tubular core.*

3. The void filler of claim 1, wherein:

said means [to allow the] *of said inner member tubular core sides for allowing said inner member tubular* core [means] *sides* to be folded [includes] *comprises* integrally fromed score indnentations.

5. The void filler of claim 1, wherein said *inner member tubular* core [means includes] *comprises*:

a *substantially* diamond shaped enclosure having foot members, *comprising said bottom and top of said inner member tubular core,* attached to said bottom and top of said outer *housing* tubular member to securely hold [the] *said inner member tubular* core [means] in position *within said outer housing tubular member; and* said [leg means comprising] *sides of said inner member tubular core comprise* diagonal members extending from each foot [and] *member,* joined at an apex, and connecting [the] *said* bottom and top *of said inner member tubular core.*

7. The void filler of claim 6, wherein said cap sheet [includes] *comprises*:

a scored portion along the length *thereof* adjacent to said flange means [to allow the] *for allowing said* cap sheet and *said* attached flange means to be moved[,] *into a position extending* upwardly and downwardly [to a nonhorizontal position] *so as to* thereby [providing] *provide* a spring force urging [the] *said* flange means *and said attached section of said cap sheet* outwardly *so as* to hold said void filler in position *with respect to said adjacent loads.*

*8. A collapsible void filler device foldable into a flat, collapsed configuration for storage, and unfoldable into an expanded configuration for preventing damage to cargo during transit, comprising:*

*an outer housing comprising a four-sided tubular member having a bottom, a top, and two sides, and a longitudinal axis extending the length thereof; and*

*an inner core member disposed within said outer housing tubular member and having a bottom connected to said bottom of said outer housing tubular member, a*

*top connected to said top of said outer housing tubular member, sides interconnecting said bottom and top of said inner core member, means provided upon said sides of said inner core member for allowing said sides of said inner core member to be folded and collapsed so as to permit said void filler to be disposed in said collapsed configuration, a width which extends across a majority of said length of said outer housing tubular member, and a length which is sized so as to contact and space apart said sides of said outer housing tubular member so as to prevent inward movement of said sides of said outer housing tubular member and thereby rigidify said outer housing tubular member when said void filler is disposed in said expanded configuration;*

*said sides of said outer housing tubular member extending upwardly from said bottom of said outer housing tubular member to said top of said outer housing tubular member when said damage prevention void filler device is disposed in said expanded configuration, said sides of said outer housing tubular member including means for permitting said sides of said outer housing tubular member to bow outwardly so as to thereby provide an outwardly directed spring force upon adjacent objects so as to hold said void filler in place when said void filler is disposed in said expanded configuration, and to permit said outer housing tubular member to easily collapse when said inner core member is collapsed whereby said void filler is disposed in said collapsed configuration, and said sides of said outer housing tubular member including oppositely extending flange portions secured to underside portions of said top of said outer housing tubular member such that said bottom of said outer housing tubular member, said outwardly bowed, collapsed sides of said outer housing tubular member, and said top of said outer housing tubular member define a cavity therebetween for housing said collapsed inner core member, when said void filler is disposed in said collapsed configuration, while said top, bottom, and portions of said sides extending from said bottom to said bow means of said outer housing tubular member define parallel planes.*

*9. A void filler as set forth in claim 8, wherein:*

*said sides of said collapsed inner core member comprise first and second layers of said collapsed void filler;*

*said flange portions of said sides of said outer housing tubular member, and portions of said sides of said outer housing tubular member extending from said bow means of said sides of said outer housing tubular member to said flange portions of said sides of said outer housing tubular member also comprise first and second layers of said collapsed void filler which are disposed in a coplanar manner with respect to said first and second layers defined by said sides of said collapsed inner core member; and*

*said top of said outer housing tubular member, and said bottom of said outer housing tubular member along with said portions of said sides of said outer housing tubular member which extend from said bottom to said bow means of said sides of said outer housing tubular member, comprise third and fourth layers of said collapsed void filler which define said parallel planes between which said first and second layers comprising said sides of said collapsed inner core member, and said first and second layers comprising said flange portions of said outer housing tubular member and said side portions of said outer housing tubular member extending from said bow means of said sides of said outer housing tubular member to said flange portions, are housed.*

*10. A void filler as set forth in claim 8, wherein:*

*said inner core member comprises a single-cell tubular core having a longitudinal axis which extends perpendicular to said longitudinal axis of said outer housing tubular member.*

*11. A void filler as set forth in claim 8, wherein:*

*said inner core member has a substantially diamond shaped configuration when said inner core member, and said void filler, are disposed in said expanded configuration.*

*12. A void filler as set forth in claim 8, wherein:*

*said means provided upon said sides of said inner core member for allowing said sides of said inner core member to be folded and collapsed comprise integrally formed score indentations.*

*13. A void filler as set forth in claim 8, wherein:*

*said means for permitting said sides of said outer housing tubular member to bow outwardly and to permit said outer housing tubular member to easily collapse comprise integrally formed score indentations.*

* * * * *